US005384934A

United States Patent [19]

Dämmig

[11] Patent Number: 5,384,934

[45] Date of Patent: Jan. 31, 1995

[54] PROCESS AND DEVICE FOR THE REGULATION OF A DRAWING FRAME

[75] Inventor: Joachim Dämmig, Ingolstadt, Germany

[73] Assignee: Rieter Ingolstadt Spinnereimaschinenbau AG, Ingolstadt, Germany

[21] Appl. No.: 10,374

[22] Filed: Jan. 28, 1993

[30] Foreign Application Priority Data

Jan. 29, 1992 [DE] Germany ..... 4202352

[51] Int. Cl.[6] ..... D01H 5/32

[52] U.S. Cl. ..... 19/239; 395/900

[58] Field of Search ..... 19/239, 240, 236, 66 CC, 19/65 A, 150, 106 R; 395/900, 563, 550; 364/470

[56] References Cited

U.S. PATENT DOCUMENTS 4,974,296 12/1990 Vidler .
5,018,248 5/1991 Haworth ..... 19/236 X
5,134,568 7/1992 Sainen ..... 395/900 X
5,230,125 7/1993 Clement et al. ..... 19/150 X

FOREIGN PATENT DOCUMENTS

0412448A1 8/1990 European Pat. Off. .
3919284A1 12/1990 Germany .
2119104 11/1983 United Kingdom ..... 19/239

*Primary Examiner*—Peter Nerbun
*Attorney, Agent, or Firm*—Dority & Manning

[57] ABSTRACT

A process for improving the regulation of a draw frame wherein measuring signals indicating thickness of a fiber sliver are detected at the input and output of the draw frame by measuring elements and processed by the regulating system of the draw frame comprising interfacing a fuzzy controller with the regulating system of the draw frame. The measuring signals indicating the thickness of the fiber sliver are inputted into the fuzzy controller. Various influencing factors which are not compensated for by the regulating system are also inputted into the fuzzy controller, the influencing factors having an effect on the measuring signals. The influencing factors are linked and weighted with respect to the measuring signals in the fuzzy controller in accordance with fuzzy inference rules based on empirical data established in the fuzzy controller. A measuring signal value is formed in the fuzzy controller based on the length and influencing factors and this correction value is applied on line to the regulating system of the draw frame before the measuring signal is processed by the regulating system beyond the element in the regulating system which generated the measuring signal.

11 Claims, 4 Drawing Sheets

PROCESS AND DEVICE FOR THE REGULATION OF A DRAWING FRAME

BACKGROUND OF THE INVENTION

The instant invention relates to the regulation of a drawing frame of the textile industry in which drafting of a fiber sliver can be modified in a controlled and/or regulated manner. The concept of regulation includes, in this case, control and/or regulation of drafting. The regulation is designed to correct environmental influences and internal machine influences so that the errors in drafting caused by these influences are compensated for. The development of regulating systems for the drafting of a fiber sliver has produced a great number of specialized controls and regulating systems according to the state of the art, and most of these are designed to handle individual, specialized problems in the overall picture of a regulating system.

Each of these regulating systems of a drawing frame is based on the formulation of a process model, as well as on the observation and evaluation of the reactions of the drawing frame to the control magnitudes so as to finally optimize the transmission characteristic of the regulator (see also EP 412 448).

In this context, the regulating algorithm describes the relationship between the control magnitudes involved. This method is very effective if the relationship between the magnitudes is simple, i.e. easy to formulate, and if it is sufficiently well known. The latter is difficult for the simulation of technical processes such as the regulation of a drawing frame because of the complexity of factors influencing the process. Such influence factors, which so far have been impossible to reliably compensate for, are for example:

- the temperature on the scanning roller
- the humidity on the fiber sliver
- stoppage time of the fiber sliver between the scanning rollers
- standing time of feeding cans filled with fiber slivers Efforts to optimize the regulation algorithm are in practice facing increasing problems of redundancy of measured values or with the stability of the regulating circuit.

Some of these influence factors are briefly discussed below:

Temperature:

For the scanning rollers sensing fiber thickness, the determining temperature after machine start-up is the environmental temperature. After start-up, the temperature of the scanning roller changes.

Friction against the fiber sliver increases the temperature until it reaches operating temperature. The transition in time to operating temperature is more or less rapid, depending on the environmental temperature. This change in temperature (with an unknown time constant) influences the elasticity of the scanning roller and therefore the excursion of the movable roller of the scanning roller, so that the actual measuring result is influenced. This temperature change also influences the sliding or roller friction factors of the scanning roller bearing.

If two identical drawing frames were to be started with the same regulation algorithm in separate production rooms at different environmental temperatures, it would be found that drafting of a fiber sliver is regulated differently during the period of time it would take until a stable operating temperature is reached. This is caused by the influences of different temperature on the elasticity of the movable roller of the scanning roller equipment.

Stoppage times of the machine are time periods during which the fiber sliver is stopped between the scanning rollers. These stoppage times produce changes in fiber sliver thickness due to different lengths of time of being clamped by the scanning rollers.

Standing time of feeding cans filled with fiber slivers is the time from filling of the cans with the slivers until further processing in the drawing frame. If such feeding cans are buffer-stored and are not immediately used for further processing, they are subject to environmental influences (environmental temperature, air humidity). This situation is also described in DE-OS 39 19 284. The properties of the fiber sliver change as a function of the length of time during which temperature and air humidity exert their influence on the sliver.

The sliver's own weight also exerts an influence in that it causes the sliver to be compressed to different degrees as a function of the height to which the can is filled (over a longer period of time).

These various influences lead to measuring errors of the measuring element in drafting, because no conventional mathematical process model exists for the processing and accommodation of magnitudes such as temperature, air humidity, stoppage time, and length of time during which cans remain standing. Regulating systems in a drawing frame, functioning on the basis of such conventional mathematical process models, are insufficiently able to compensate for the above-described influences upon the measuring signals.

OBJECTS AND SUMMARY OF THE INVENTION

It is a principal object of the instant invention to correct measuring signals of the regulating system in a drawing frame so that the drafting of the fiber sliver can be further optimized. Additional objects and advantages of the invention will be set forth in part in the following description, or will be obvious from the description, or may be realized by practice of the invention.

The measured value of fiber sliver thickness produced by a measuring device on the drawing frame is error-prone to different degrees, depending on the measuring method used, due to the influence factors mentioned above.

Measuring errors produced at the input scanning roller (scanning roller near the input of the drawing frame) can be minimized by a Fuzzy Controller, as described below.

According to the instant invention, a Fuzzy Controller is connected to the existing regulating system of the drawing frame. A Fuzzy Controller is a conventional signal processing system which links the measuring signal to the influence factors discussed, evaluates the signals by means of Fuzzy logic, and produces a corresponding correction value. This Fuzzy Controller receives the measuring signal delivered by the input scanning roller, as well as the measuring signal supplied by the output scanning roller directly after the A/D transformer. The impulse clock supplies its impulses to the Fuzzy Controller in order to synchronize the measuring signals with the passage of the fiber sliver. At least the following influence factors represent a further input into the Fuzzy Controller:

Temperature of the scanning roller
Air humidity in the environment of the fiber sliver
Stoppage time of the fiber sliver between the scanning rollers
Standing time of feeding cans filled with fiber slivers
Material properties of the fiber sliver; and
Output speed of the drawing frame.

However, additional influence factors not mentioned here can be used as additional input to the Fuzzy Controller.

The Fuzzy Controller processes signals according to the Fuzzy logic as required and adapted for a drawing frame.

For this purpose, the incoming measuring signals are fuzzyfied, to be then weighted by inference and linked together with the appropriate influence factors through Fuzzy rules formulated on basis of past experience. A signal characteristic which is a measure for the desired correction value is produced in the defuzzyfication.

It is a characteristic of the invention that a measuring signal subjected to influences and coming from the measuring element (scanning roller) is corrected on-line in the FIFO (First-In-First-Out) memory before any further processing. This correction is effected in a digital multiplication step upstream of the FIFO memory, between measuring signal and characteristic signal magnitude of the correction value. The errors caused by the influence factors are thereby corrected.

If the error continues to exist in an altered form in the output signal of the drafting regulation system, the regulation onset point (FIFO length) and regulation amplification, depending on the position and form of the change, can be determined. For this purpose, the Fuzzy Controller changes the detected regulation onset point in on-line operation from the regulation onset point of the conventional regulating system by changing the FIFO length in the electronic memory and/or changing the regulation amplification in the control device.

If periodic errors which are not present in the incoming sliver are present in the output signal, a machine error is signalled by the Fuzzy Controller.

The Fuzzy Controller can be structured as an analog computer with discrete transistor technology, with gate arrays with conventional microprocessors, with signal processors, or with special Fuzzy processors. In this case, the drafting regulation and the production of correction values can also be realized by means of Fuzzy Control Logic within a CPU of suitable capacity (e.g. a signal processor).

Drafting regulation is then effected in an interrupted-control mode via the machine clocking impulse. The remaining computer capacity is then at the disposal of the Fuzzy Controller.

An embodiment of the invention is shown in the drawing and is described in further detail below.

DETAILED DESCRIPTION OF THE PREFERRED EMBODIMENTS

Figure 1:
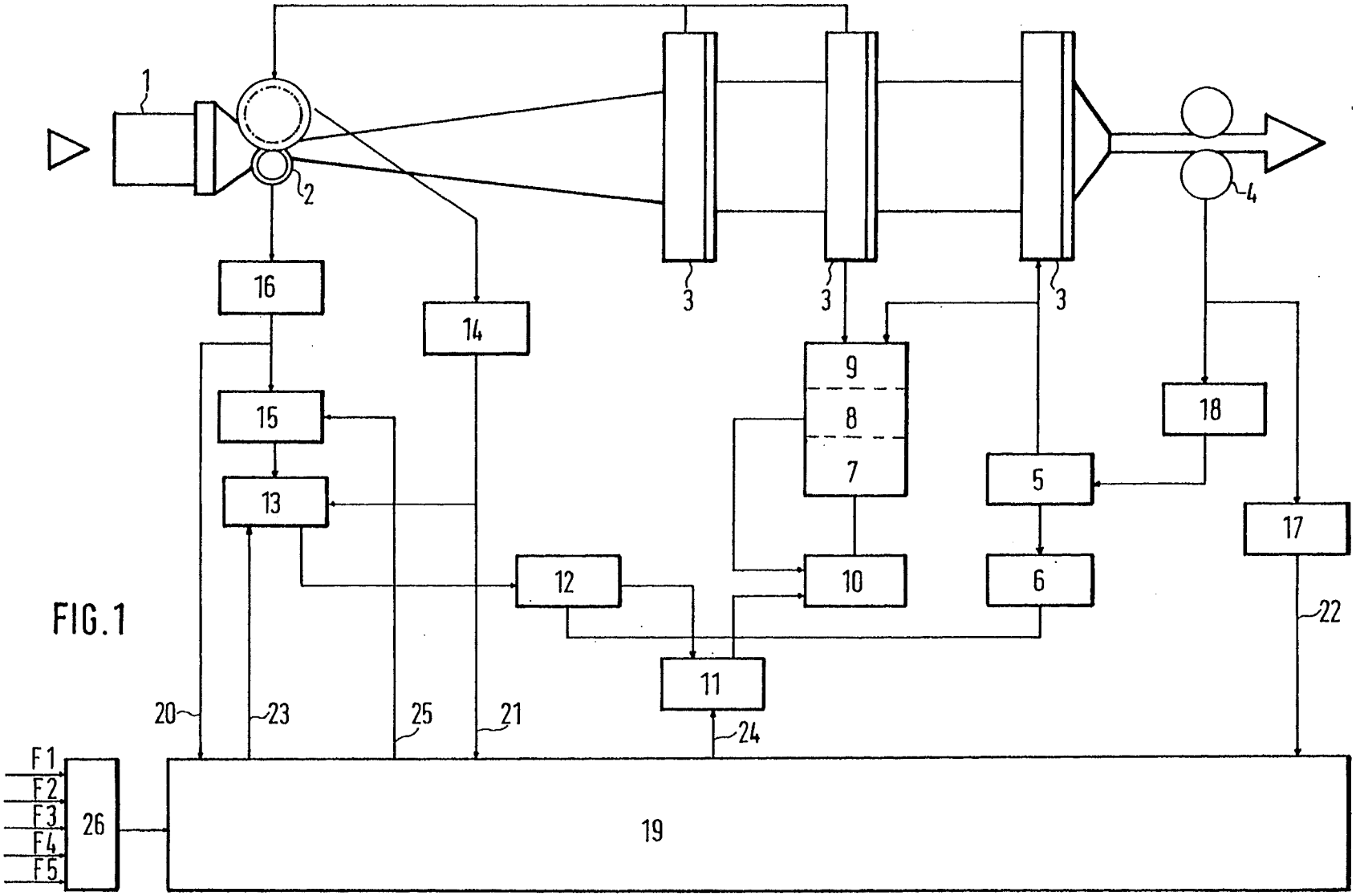
FIG. 1 shows the functional connections of a regulating system on a drawing frame with Fuzzy Control.

Reference will now be made in detail to one or more preferred embodiments of the present invention, one or more examples of which are illustrated in the drawings. Each example is provided by way of explanation of the invention, not limitation of the invention.

FIG. 1 shows schematically that the fiber sliver 1 enters the input scanning roller 2 and is drafted between the three roller pairs 3 of the drawing frame. An output scanning roller 4 is installed at the output of the drawing frame. FIG. 1 furthermore shows conventional drafting controls. A sliver monitor 18 is installed over the output scanning roller in a conventional regulating system, this monitor being capable of stopping the main motor 5 when limit values are exceeded.

According to the invention, a Fuzzy Controller 19 is connected to the existing regulating system of the drawing frame. The interfaces with the conventional regulating system which represent an input of the Fuzzy-Controller are circuit lines 20 for the measuring signal coming from the input scanning roller, as well as circuit 22 for the measuring signal of the output scanning roller 4, with an A/D transformer 17 connected between them. Furthermore the fiber sliver speed is transmitted via pulse generator 14 via circuit 21 to the Fuzzy Controller 19. The signals for temperature F1, air humidity F2, stoppage time of the machine F3, stoppage time of full feeding cans F4, and material characteristics of the fiber sliver F5 are supplied as additional input to the Fuzzy Controller.

The delivery speed transmitted over the impulse generator 14 and the signals F1, F2, F3, F4 and F5 are computed in the Fuzzy Controller into scanning roller correction values 25 according to the process to be discussed.

The magnitude signals 23, 24 for a regulation onset point (FIFO length) and regulation amplification are also produced by means of Fuzzy logic from the input of circuit lines 20, 21 and 22.

Figure 2:
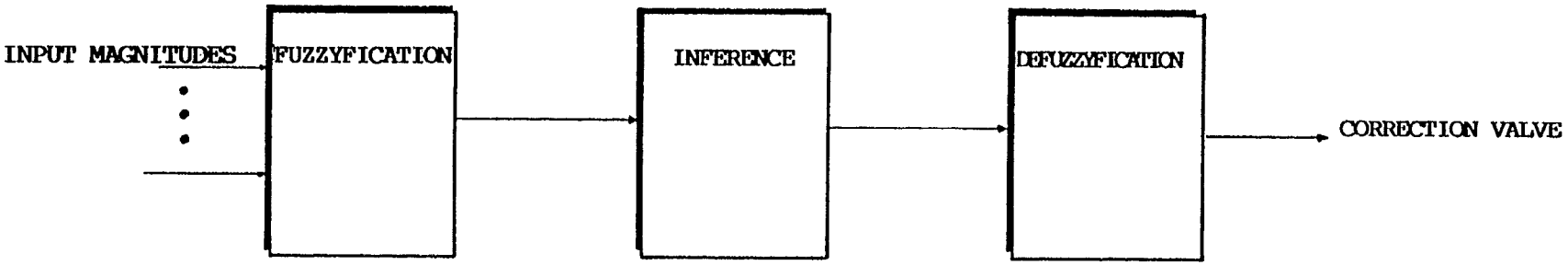
FIG. 2 shows the progress of the detection of an error magnitude according to the Fuzzy logic.

FIG. 2 shows in this context the characteristic steps for the correction of the measuring signal coming from the input scanning rollers.

Fuzzyfication:

Each measuring signal has at least one function, shown in the form of a matrix, in the computer. The X-scaling of this function has a numerical counterpart in the incoming measuring signal. The Y-scaling corresponds to the degree of truth of the measuring signal and can assume any value between 0 and 1. The change in function contains expert knowledge and corresponds to the evaluated effect of the influence magnitudes on the measuring signal.

Inference: The following inference rules link together the momentary states of the influence factors and measuring signal in the diagrams based on empirical technical knowledge of the direction and strength of influences. This can for example take the following aspect:

---

Rule 1: Temperature evolution of the mechanical elements
IF stoppage time = short AND temperature = normal
THEN correction value = minimally positive.
Rule 2: Material-dependent compression
IF stoppage time = short AND material constant = cotton
THEN correction value = medium positive -continued

| |
|---|
| Rule 3: Swelling of Cotton<br>IF can storage time = long AND air humidity = humid<br>AND material = cotton<br>THEN correction value = medium negative.<br>Rule 4: Speed Dependency<br>IF delivery = small<br>THEN correction value = large positive |

Based on these Fuzzy rules of logic, the degree of truth of the rule can, for example, be as follows in a practical case:

| |
|---|
| Rule 1:<br>Stoppage time being 10 minutes - degree of truth .5 -<br>Temperature being 25 degrees - degree of truth .9 -<br>Degree of truth of the rule: .5 - |
| Rule 2:<br>Stoppage time being 10 minutes - degree of truth .5 -<br>Share of cotton being 80% - degree of truth .8 -<br>Degree of truth of the rule: .5 - |
| Rule 3:<br>Can storage time being 1.5 hours - degree of truth .24 -<br>Air humidity being 80% - degree of truth .5 -<br>Share of cotton being 80% - degree of truth .8 -<br>Degree of truth of the rule: .24 - |
| Rule 4:<br>Momentary Delivery being 100 m/Min;; - degree of truth .67<br>Degree of truth of the rule: .67 |

Figure 4:
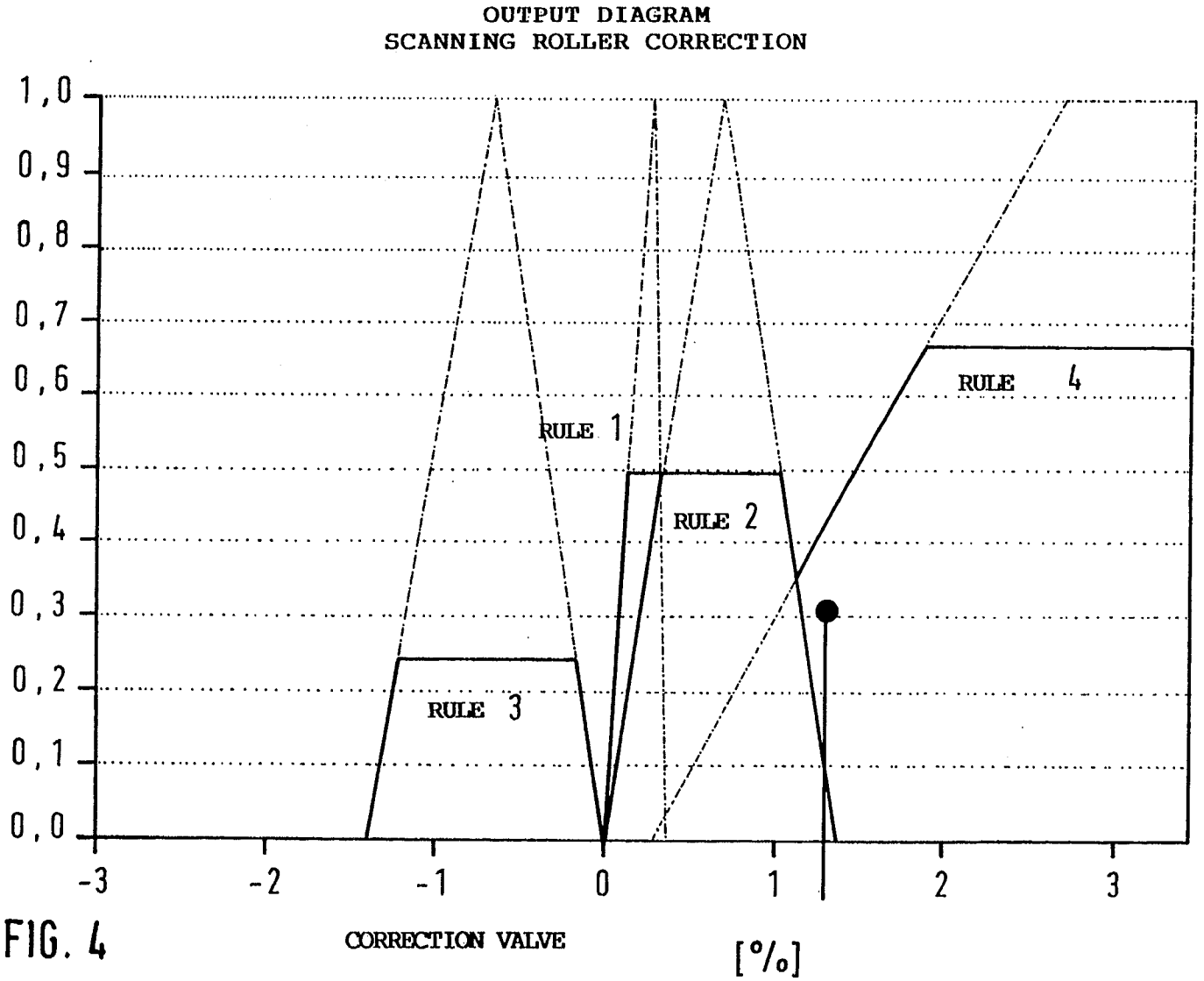
FIG. 4 shows momentary states of a scanning roller correction in function of inference.

Defuzzyfication:

The inference information resulting from application of the inference rules is "Defuzzyfied" or "Backed-Out" by the Fuzzy Controller and represents a signal characteristic which is a measure for the correction value as compared with the measuring signal. Based on the example, the result is a momentary correction value of +1.3 percent (see FIG. 4).

The signal of delivery speed supplied via circuit 21 is processed in the Fuzzy Controller with the factors F1 to F5 according to Fuzzy logic. For this purpose, the Fuzzy Controller delivers a scanning roller correction value 25 into the multiplier 15 for the correction of the defective measuring signal. The corrected measuring signal emerges at the output of the multiplier 15. Thus a measuring signal that is corrected in real time and as a function of the influence factors F1 to F5 is available as an input magnitude for the subsequent conventional control. This measuring signal is transmitted to the FIFO memory 13 and is delayed and undergoes further processing in the conventional desired-value circuit 12. The desired-value circuit 12 receives the signal of the actual delivery speed from the lead speedometer 6 of the main motor.

The continued evolution is a function of the analysis of an output signal at draft correction. If the error continues to be present in an altered form in the output signal which is formed via scanning roller 4 and is transmitted via circuit 22 to the Fuzzy Controller 19, the Fuzzy Controller 19 can change the correction value of the regulation onset point (FIFO length) and/or of the regulation amplification as a function of position and form of the change. The correction value found for the regulation onset point 23 is transmitted directly to the FIFO memory 13 and causes a change of the regulation onset point through correction of the FIFO length. The output signal coming from FIFO memory 13 goes via desired-value circuit 12 into a multiplier 11. In case that the regulation amplification must also be corrected, the Fuzzy Controller 19 transmits the correction value for regulation amplification into a second input of the multiplier 11. The output of the multiplier 11 delivers a corrected regulation amplification to the control device 10. The control device 10 acts upon a regulating system including a regulating motor 7 having an actual-value tachometer 8, so that drafting can be modified in combination with planetary gearing 9.

It is also possible to use an artificial signal leap of known magnitude and length which can be inserted at the FIFO input in order to determine FIFO length and regulation amplification. The resulting response obtained from the measuring signal of the output scanning roller can then be processed. However, this process is applicable only when the machine is started (drafting value), since a limited length of unusable material is then produced.

Figure 3:
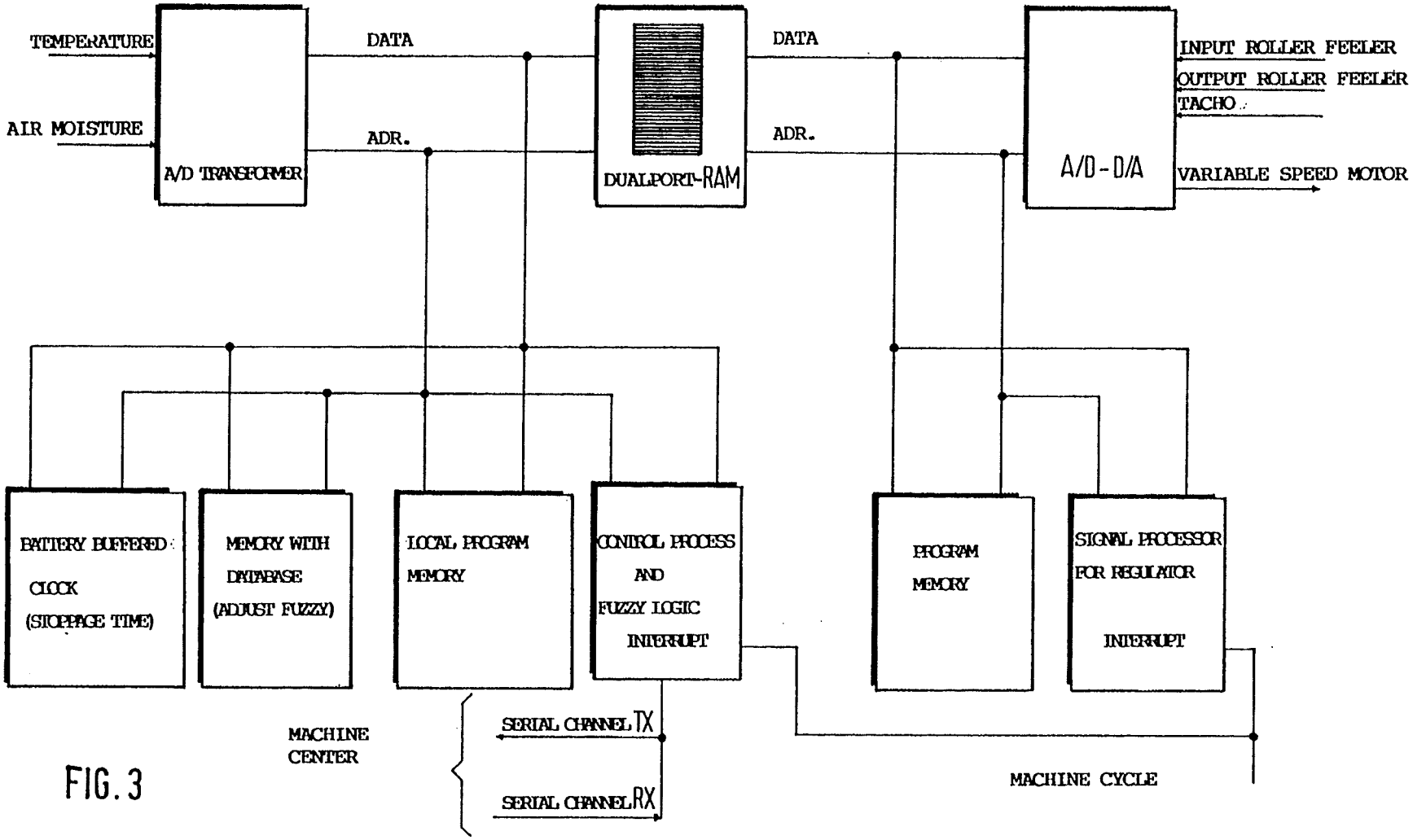
FIG. 3 shows essential hardware of a Fuzzy Control and their interfaces.

FIG. 3 shows that the hardware of the Fuzzy Controller 19 consists of the components:

Control processor and Fuzzy logic
Local program memory
Memory with experience data base
Clock with battery back-up The Fuzzy Controller is coupled together with the computer for drawing frame regulation (signal processor for the regulation) via a dual-port RAM. The influence parameters of Temperature
Air humidity
Stoppage time of the machine are transmitted via an A/D transformer to the Fuzzy Controller. The influence factors Standing time of full feeding cans
Material characteristics of the fiber sliver are transmitted via serial channel RX from the machine central computer to the control processor and to the Fuzzy logic. The scanning roller is coupled to a speedometer which converts delivery speed into a signal which is transmitted to the machine computer and to the Fuzzy Controller. The measuring signals of the measuring elements (input scanning roller, output scanning roller) are transmitted via an A/D transformer to the machine computer and at the same time, via the dual-port RAM to the Fuzzy Controller. The correction values for the measuring signal, the regulation onset point and the amplification calculated in the Fuzzy Controller are transmitted via the dual-port RAM to the signal processor for the regulation, and the regulating motor is thus regulated by means of the corrected signals.

The correction values calculated in the Fuzzy Controller are transmitted at the same time via serial channel TX of the control processor to the machine central computer.

It will be apparent to those skilled in the art that various modifications and variations can be made in the present invention without departing from the scope or spirit of the invention. For example, features illustrated as part of one embodiment can be used on another embodiment to yield a still further embodiment. It is intended that the present invention cover such modifications and variations as come within the scope of the appended claims and their equivalents.

I claim:

1. A process for improving the regulation of a draw frame wherein measuring signals indicating thickness of a fiber sliver are detected at the input and output of the draw frame by measuring elements and processed by a regulating system of the draw frame, said process comprising the steps of:

interfacing a fuzzy controller with the regulating system of the draw frame;

inputting the measuring signals indicating the thickness of the fiber sliver into the fuzzy controller;

inputting various influencing factors not compensated for by the regulating system into the fuzzy controller, the influencing factors having an effect on the measuring signals;

linking and weighting the influencing factors with respect to the measuring signals in the fuzzy controller in accordance with fuzzy inference rules based on empirical data established in the fuzzy controller;

forming a measuring signal correction value in the fuzzy controller based on the linked and weighted influencing factors; and applying the correction value on line to the regulating system of the draw frame before the measuring signals are processed by the regulating system beyond the elements which generated the measuring signals.

2. The process as in claim 1, comprising inputting the temperature of the draw frame scanning roller as an influencing factor.

3. The process as in claim 1, comprising inputting the humidity of the environment of the fiber sliver to be processed by the draw frame as an influencing factor.

4. The process as in claim 1, comprising inputting the stoppage time of the fiber sliver between scanning rollers of the draw frame as an influencing factor.

5. The process as in claim 1, comprising inputting the standing time of feeding cans filled with fiber sliver to be processed by the draw frame as an influencing factor.

6. The process as in claim 1, comprising inputting the material characteristics of the fiber sliver to be processed by the draw frame as an influencing factor.

7. The process as in claim 1, comprising inputting the delivery speed of the draw frame as a influencing factor.

8. The process as in claim 1, comprising inputting the temperature of the scanning rollers of the draw frame, the humidity of the environment of the fiber sliver, the stoppage time of the fiber sliver between the scanning rollers, standing time of the feeding cans filled with the fiber sliver to be processed by the draw frame, the material properties of the fiber sliver to be processed by the draw frame, and the delivery speed of the draw frame as influencing factors.

9. The process as in claim 1, wherein said linking and weighting the influencing factors according to fuzzy inference rules further comprises:

processing inputted influencing factors of stoppage time of the draw frame and temperature of the draw frame scanning rollers according to a first fuzzy rule to infer the effect of temperature on the measuring elements;

processing inputted influencing factors of stoppage time of the draw frame and material characteristics of the fiber sliver according to a second fuzzy rule to infer the effect of compression of the fiber sliver;

processing the inputted influencing factors of storage time of the fiber sliver in feeding cans and humidity of the environment of the stored fiber sliver according to a third fuzzy rule to infer the effect of swelling of the fiber sliver;

processing the inputted influencing factor of draw frame delivery speed according to a fourth fuzzy rule to infer a delivery speed correction; and inferring and applying an inference correction value from the result of the application of the four fuzzy rules.

10. The process as in claim 1, further comprising linking the measuring signal from the measuring element in a digital multiplication to the correction value from the fuzzy controller before inputting the measuring signal into a memory of the draw frame regulating system.

11. The process as in claim 1, further comprising analyzing the measuring signal from the measuring element at the output of the draw frame with the fuzzy controller to determine the response of the draw frame, and if necessary correcting the regulation onset point and regulation amplification through correction values generated by the fuzzy controller and inputted to the regulating system of the draw frame.

* * * * *